US010311831B2

(12) United States Patent
Lin et al.

(10) Patent No.: US 10,311,831 B2
(45) Date of Patent: Jun. 4, 2019

(54) DISPLAY SYSTEM AND METHOD FOR DISPLAYING AN IMAGE WITH A HIGH QUALITY

(71) Applicant: BENQ CORPORATION, Taipei (TW)

(72) Inventors: Hsin-Nan Lin, Taipei (TW); Chung-Yu Huang, Taipei (TW)

(73) Assignee: BenQ Corporation, Taipei (TW)

( * ) Notice: Subject to any disclaimer, the term of this patent is extended or adjusted under 35 U.S.C. 154(b) by 0 days.

(21) Appl. No.: 15/883,050

(22) Filed: Jan. 29, 2018

(65) Prior Publication Data

US 2018/0233109 A1 Aug. 16, 2018

(30) Foreign Application Priority Data

Feb. 15, 2017 (CN) ..... 2017 1 0081957

(51) Int. Cl.
*G09G 5/10* (2006.01)
*G09G 5/00* (2006.01)

(52) U.S. Cl.
CPC ..... *G09G 5/10* (2013.01); *G09G 5/003* (2013.01); *G09G 2310/06* (2013.01); *G09G 2310/08* (2013.01); *G09G 2320/0247* (2013.01); *G09G 2320/064* (2013.01)

(58) Field of Classification Search
CPC ..... G09G 5/10; G09G 5/003; G09G 2310/08; G09G 2320/0247; G09G 2320/064; G09G 2310/06; G09G 3/3406; G09G 3/3413; G09G 3/342; G09G 3/3426; G09G 2320/0633; G09G 2320/02
See application file for complete search history.

(56) References Cited

U.S. PATENT DOCUMENTS

| | | | | |
|---|---|---|---|---|
| 2011/0128303 | A1* | 6/2011 | Yonemaru | H05B 33/0827 345/690 |
| 2015/0130361 | A1* | 5/2015 | Zhang | H05B 33/083 315/186 |
| 2016/0284308 | A1* | 9/2016 | Jeon | G09G 3/3406 |
| 2017/0110044 | A1* | 4/2017 | Ahn | G09G 3/2003 |
| 2017/0193925 | A1* | 7/2017 | Park | G09G 3/3406 |

* cited by examiner

*Primary Examiner* — Premal R Patel

(57) ABSTRACT

A method for displaying an image includes acquiring a data clock signal, acquiring a vertical synchronization signal, generating a backlight driving signal according to the vertical synchronization signal, and displaying the image by using a display system according to the data clock signal, the vertical synchronization signal, and the backlight driving signal. The data clock signal includes a first square wave. The vertical synchronization signal includes a second square wave. No common time interval is between a first time interval corresponding to the first square wave and a second time interval corresponding to the second square wave. The backlight driving signal includes a composite wave synthesized by a third square wave and at least one pulse width modulation signal.

21 Claims, 11 Drawing Sheets

DISPLAY SYSTEM AND METHOD FOR DISPLAYING AN IMAGE WITH A HIGH QUALITY

BACKGROUND OF THE INVENTION

1. Field of the Invention

The present invention illustrates a display system and a method for displaying an image, and more particularly, a display system and a method for displaying an image with a high quality by reducing a motion blur effect.

2. Description of the Prior Art

Liquid crystal display (LCD) devices and organic light emitting diode (OLED) display devices have been widely applied to multimedia players, mobile phones, personal digital assistants, computer monitors, or flat-screen TV devices because of their slim appearance, low power consumption, and no radiation properties.

Conventional display device uses a pulse width modulation signal for driving a backlight source when images are displayed on a screen. The backlight source is enabled or disabled during a time interval greater than an image frame duration according to the pulse width modulation signal. In the conventional display device, a user easily feels an image flickering effect when the image is displayed, thereby reducing the visual quality. Also, when the image belongs to a high-speed dynamic image and is displayed by using the screen with a high refresh frequency, a motion blur effect easily occurs, leading to reduced image quality. Further, the user can see a transient effect of unstable pixels when the image is in the process of having their pixels refresh polarities during the time interval of the backlight source being enabled. Therefore, it is easy for the user to see the unpleasant image flickering effect. Moreover, even if the user does not notice the image flickering effect of the screen when a high-speed image flickering effect or a high-frequency image flickering effect occurs, the user may unconsciously feel tired or suffer from permanent vision damage after watching flickering images for a long time.

SUMMARY OF THE INVENTION

In an embodiment of the present invention, a method for displaying an image is disclosed. The method comprises acquiring a data clock signal, acquiring a vertical synchronization signal, generating a backlight driving signal according to the vertical synchronization signal, and displaying the image by using a display system according to the data clock signal, the vertical synchronization signal, and the backlight driving signal. The data clock signal comprises a first square wave. The vertical synchronization signal comprises a second square wave. No common time interval is between a first time interval corresponding to the first square wave and a second time interval corresponding to the second square wave. The backlight driving signal comprises a composite wave synthesized by a third square wave and at least one pulse width modulation signal.

In another embodiment of the present invention, a display system is disclosed. The display system comprises a backlight driving device and a backlight module. The backlight driving device is configured to generate a switch control signal and a current control signal according to a current dividing signal, a backlight driving signal, and a maximum current setting signal. The backlight module is coupled to the backlight driving device and configured to drive at least one light-emitting diode string according to the switch control signal and the current control signal. The backlight driving device comprises a driving circuit configured to receive the current dividing signal through a voltage divider formed by a plurality of resistors, the backlight driving signal through a resistor-capacitor circuit, and the maximum current setting signal through a resistor. The backlight driving signal comprises a composite wave synthesized by a third square wave and at least one pulse width modulation signal.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
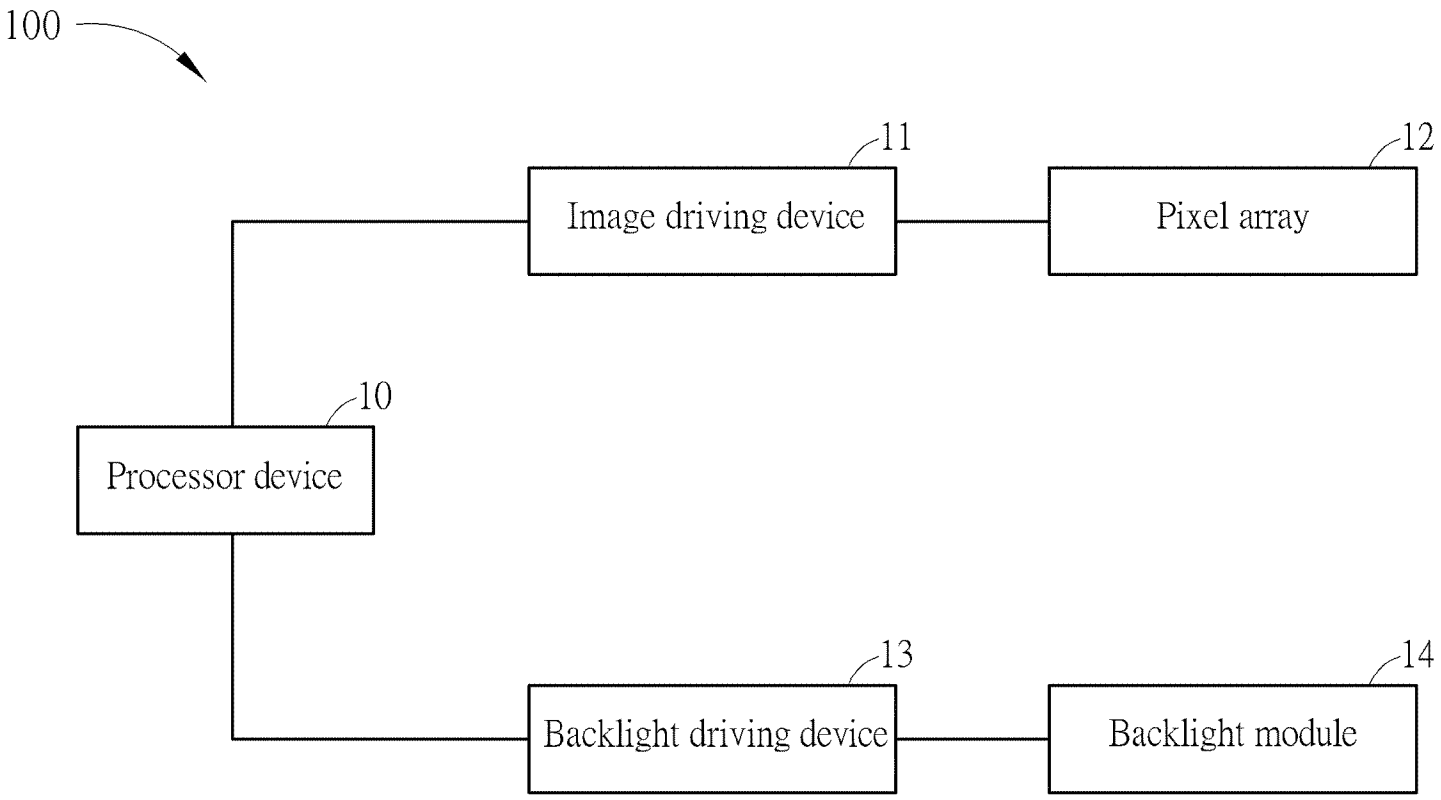
FIG. 1 is a block diagram of a display system according to an embodiment of the present invention.

FIG. 1 is a block diagram of a display system 100 according to an embodiment of the present invention. The display system 100 includes a processor device 10, an image driving device 11, a pixel array 12, a backlight driving device 13, and a backlight module 14. The processor device 10 can be any logical device capable of performing programmable operations, such as a scalar (i.e., a chip processor), a central processing unit, a micro-processor, or a programmable control unit. The image driving device 11 is coupled to the processor device 10 for generating a voltage used for driving the pixel array 12. The backlight driving device 13 is coupled to the processor device 10 for generating a voltage used for driving the backlight module 14. The image driving device 11 can be any device including a shift register for enabling scan lines and data lines. Particularly, the image driving device 11 can drive the pixel array 12 by using a row-by-row driving mode. The pixel array 12 includes a plurality of pixels capable of displaying various colors. The backlight driving device 13 can be any device capable of driving the backlight module 14 according to at least one pulse width modulation signal. The backlight module 14 can be any device capable of emitting a light signal. For example, the backlight module 14 can include at least one light-emitting diode string. When the display system 100 is used for displaying the image, the processor device 10 can generate a data clock signal, a vertical synchronization signal, and a backlight driving signal. However, the backlight driving signal can also be generated by a backlight control device integrated to the processor device 10. The data clock signal includes at least one first square wave. The processor device 10 can control the image driving device 11 to generate a driving voltage for driving each row of pixels (i.e., each row of pixels corresponding to a scan line) during a first time interval of the first square wave. The vertical synchronization signal includes at least one second square wave. Particularly, no common time interval is between the first time interval corresponding to the first square wave and a second time interval corresponding to the second square wave. In other words, a position of the second square wave of the vertical synchronization signal is located between two consecutive first square waves of the data clock signal. The backlight driving signal includes at least one composite wave. Each composite wave is synthesized by a third square wave and at least one pulse width modulation signal. The display system 100 can display the image according to the data clock signal, the vertical synchronization signal, and the backlight driving signal.

In the display system 100, relative positions among the data clock signal, the vertical synchronization signal, and the backlight driving signal can be appropriately designed for reducing image distortion caused by a motion blur effect. As previously mentioned, in the conventional display device, a backlight module is enabled constantly or enabled for a long time period greater than several image frames. In other words, in the conventional display device, the backlight module is enabled during the first time intervals corresponding to the first square waves of the data clock signal. Since a processor device of the conventional display system controls an image driving device 11 to generate a driving voltage for driving each row of pixels during the first time interval of the first square wave, the polarity of each pixel is not stable. Further, since the backlight module is enabled constantly or enabled for a long time period, a user can see a transient effect of unstable pixels when the pixels are in the process of refreshing their polarities. Thus, in the conventional display system, when a high refresh frequency is required or a high-speed visual effect is required, image distortion is unavoidable because the motion blur effect is severe. However, in the display system 100, no common time interval is between the first time interval corresponding to the first square wave generated by the processor device 10 and the second time interval corresponding to the second square wave generated by the processor device 10. In other words, when the backlight driving signal is consistent with the vertical synchronization signal, although the polarity of the each pixel is not stable during the first time interval, the polarity of each pixel becomes stable after the first time interval elapses. Further, the backlight drive signal enables the backlight module 14 according to the vertical synchronization signal after the first time interval elapses. Therefore, a process of refreshing polarities of each row of pixels in the pixel array 12 is invisible during a human-viewable time interval (i.e., a time interval when the backlight module 14 is enabled) . Therefore, the display system 100 can effectively reduce image distortion caused by the motion blur effect even when a high frame rate for refreshing pixels is required. However, compared with the backlight module constantly enabled in the conventional display system, the backlight module 14 of the display system 100 is operated under a smaller duty cycle. Thus, the displayed images of the display system 100 may suffer from insufficient brightness. In order to boost brightness of the displayed images without introducing the motion blur effect, the backlight driving signal of the present invention can be appropriately designed to increase the image brightness. In the following, circuit structures of the backlight driving device 13 and the backlight module 14 of the display system 100, and the design of the backlight driving signal for increasing image brightness are illustrated.

Figure 2:
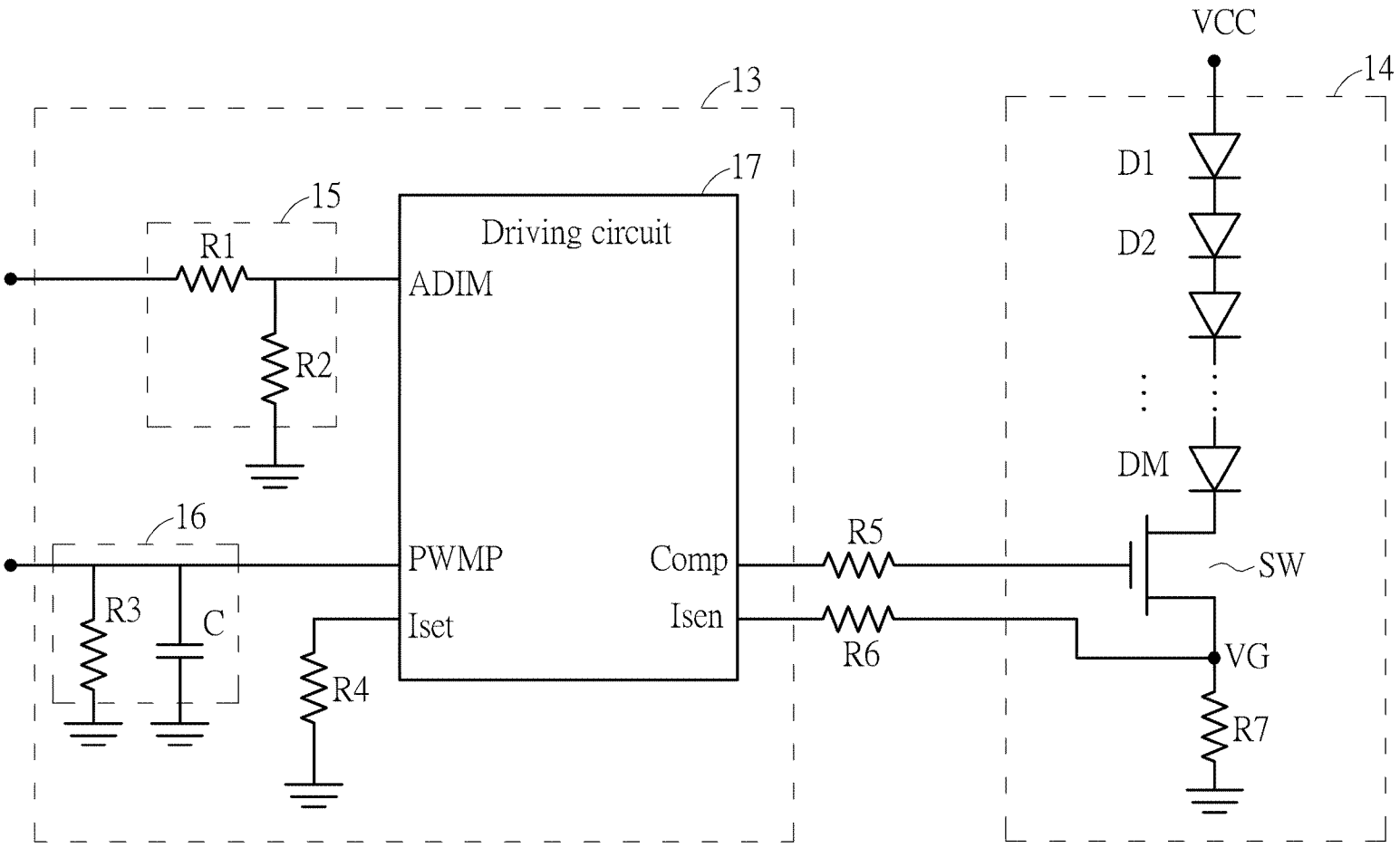
FIG. 2 illustrates circuit structures of a backlight driving device and a backlight module of the display system in FIG. 1.

FIG. 2 illustrates circuit structures of the backlight driving device 13 and the backlight module 14 of the display system 100. The backlight driving device 13 includes a driving circuit 17 for generating a switch control signal and a current control signal according to a current dividing signal, a backlight driving signal, and a maximum current setting signal. Definitions of aforementioned signals are illustrated below. The current dividing signal is received by a current dividing pin ADIM of the driving circuit 17. The current dividing signal can be used for setting a current passing through the light-emitting diode string of the backlight module 14. The current dividing pin ADIM of the driving circuit 17 can receive the current dividing signal through a voltage divider 15. The voltage divider 15 can be formed by a resistor R1 and a resistor R2 . However, the voltage divider 15 can be formed by any reasonable hardware capable of diving voltage. The backlight driving signal is received by a backlight driving pin PWMP of the driving circuit 17. The backlight driving signal is used for setting a duty cycle and an intensity of the driving voltage of the backlight module 14. The backlight driving pin PWMP of the driving circuit 17 can receive the backlight driving signal through a resistor-capacitor (RC) circuit 16. The RC circuit 16 can be formed by a resistor R3 and a capacitor C connected in parallel . The RC circuit 16 is capable of regulating voltage and avoiding ripple interference. The maximum current setting signal is received by a maximum current setting pin Iset of the driving circuit 17. The maximum current setting signal is used for setting a maximum current value of the light-emitting diode string (i.e., including light-emitting diodes D1 to DM) of the backlight module 14. The maximum current setting pin Iset can receive the maximum current setting signal through a resistor R4. After the current dividing signal is received by a current dividing pin ADIM, the backlight driving signal is received by the backlight driving pin PWMP, the maximum current setting signal is received by the maximum current setting pin Iset, a switch control pin Comp of the driving circuit 17 can generate the switch control signal for controlling a switch SW of the backlight module 14 through a resistor R5. Further, a current control signal Isen of the driving circuit 17 can generate the current control signal for controlling a virtual ground voltage VG of the light-emitting diode string (i.e., including light-emitting diodes Dl to DM) of the backlight module 14. In other words, since the virtual ground voltage VG of the light-emitting diode string can be controlled by a voltage level of the current control signal Isen, a voltage difference (i.e., VCC-VG) between a high voltage VCC and the virtual ground voltage VG can be controlled for adjusting a current passing through the light-emitting diode string of the backlight module 14. In the display system 100, the light-emitting diodes Dl to DM can be connected in series. M is a positive integer greater than one. However, the backlight module 14 of the present invention is not limited to using a single light-emitting diode string. For example, a plurality of light-emitting diode strings can be applied to the backlight module 14. As previously mentioned, in order to boost brightness of the displayed image without introducing the motion blur effect, the backlight driving signal of the present invention can be appropriately designed to enhance image brightness. Some embodiments of designs of the backlight driving signals are illustrated below.

Figure 3:
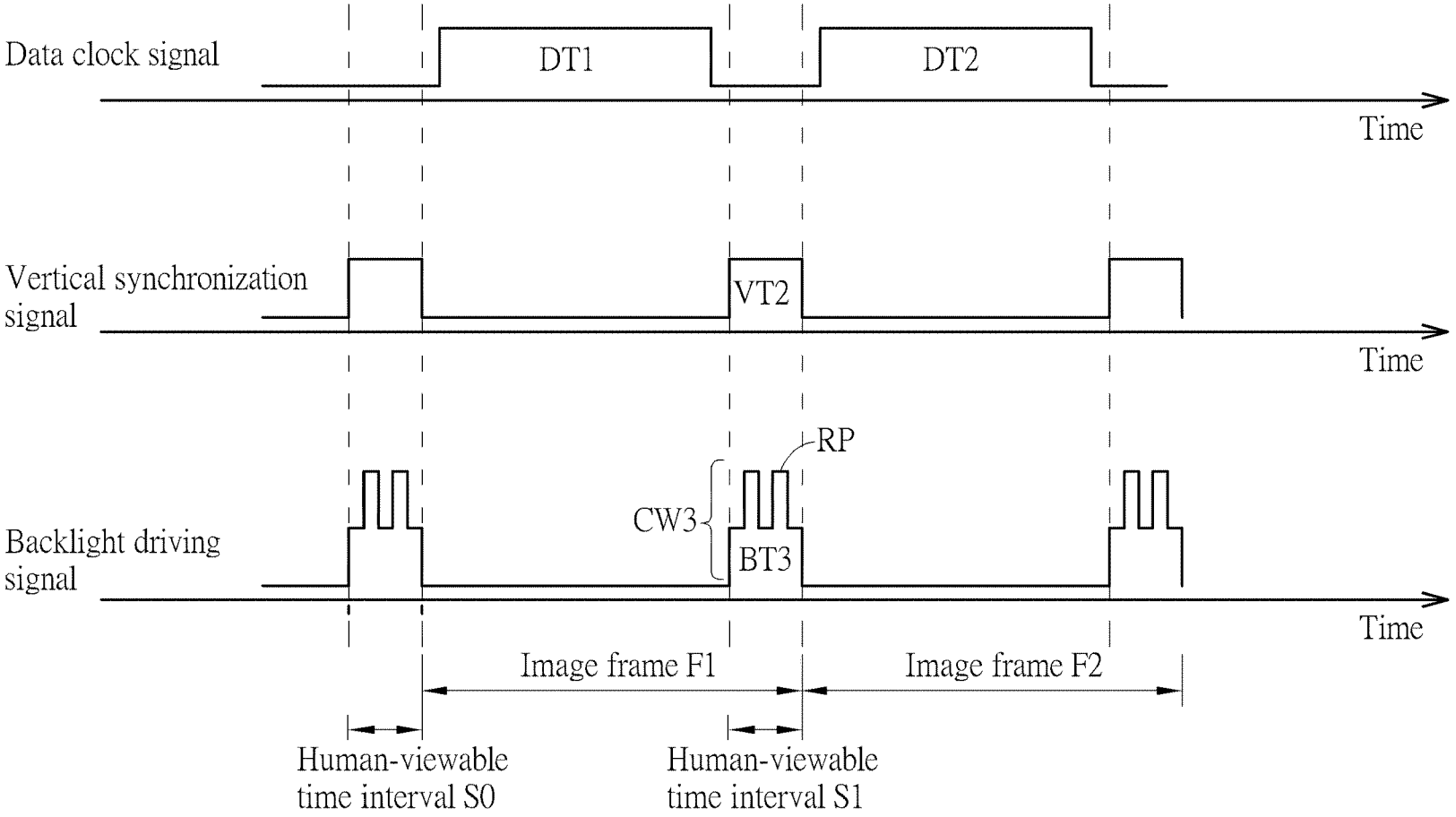
FIG. 3 is an illustration of a first correlation of a data clock signal, a vertical synchronization signal, and a backlight driving signal of the display system in FIG. 1.

FIG. 3 is an illustration of a first correlation of a data clock signal, a vertical synchronization signal, and a backlight driving signal of the display system 100. In the embodiment, a first square wave DT1 of the data clock signal corresponds to an image frame Fl. A first square wave DT2 of the data clock signal corresponds to an image frame F2. Specifically, no common time interval is between a first time interval corresponding to the first square wave (DT1 or DT2) and a second time interval corresponding to the second square wave VT2 of the vertical synchronization signal. Here, the second square wave VT2 of the vertical synchronization signal is between the first square wave DT1 and the first square wave DT2. In FIG. 3, the backlight driving signal includes a composite wave CW3, which is synthesized by a third square wave BT3 and at least one pulse width modulation signal RP. Timing of a rising edge of the third square wave BT3 substantially matches with timing of a rising edge of the second square wave VT2. Timing of a falling edge of the third square wave BT3 substantially matches with the timing of a falling edge of the second square wave VT2. Further, positions, amplitudes, and number of the pulse width modulation signals RP are not limited to the composite wave CW3. Any reasonable signal modification falls into the scope of the present invention. Further, the third square wave BT3 can also be a pulse width modulation signal with a peak duty cycle substantially equal to 1/20. In FIG. 3, in the image frame F1, pixel polarities of the pixel array 12 may be unstable during the first time interval of the first square wave DT1 of the data clock signal. However, the backlight module 14 is enabled during the third time interval of the composite wave CW3. Since the first time interval is followed by the third time interval, disturbance of the pixel polarities of the pixel array 12 can be invisible during a human-viewable time interval S1. In other words, a displayed image during the human-viewable time interval S1 can be regarded as a stable image since their pixel polarities are already converged to a steady state. As a result, for the displayed image during the human-viewable time interval S1, image distortion caused by the motion blur effect can be mitigated. Further, since the composite wave CW3 with a comparatively large power is introduced to the backlight driving signal, equivalently, a driving voltage of the backlight module 14 is boosted during the third time interval. Thus, average brightness of the backlight module 14 can be increased. Operations of a following image frame F2 is similar to operations of the image frame F1. Thus, an illustration of the image frame F2 is omitted here. Additionally, timing of a rising edge of the third square wave BT3 and timing of a falling edge of the third square wave BT3 can be within the second time interval of the square wave VT2.

Figure 4:
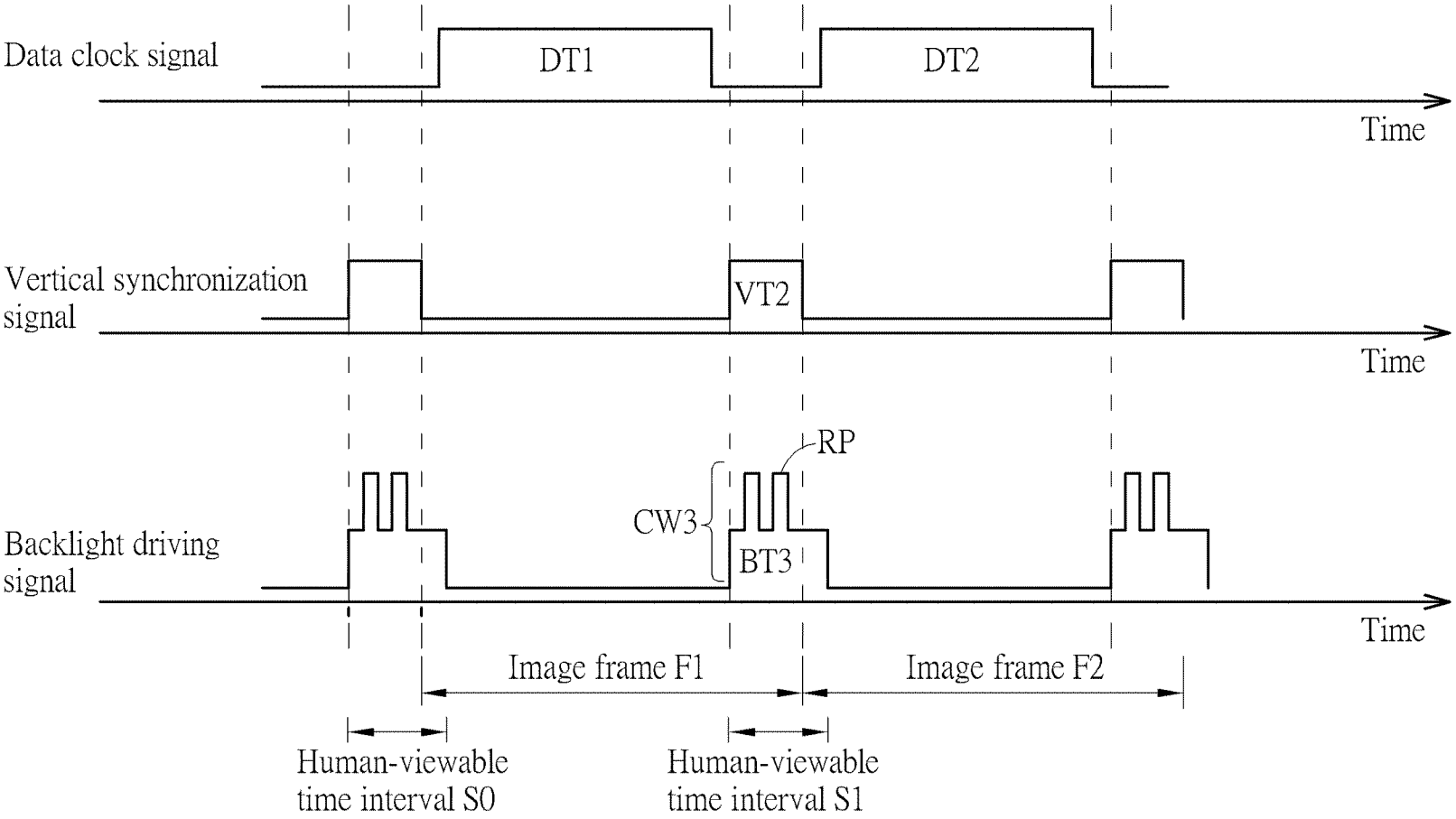
FIG. 4 is an illustration of a second correlation of the data clock signal, the vertical synchronization signal, and the backlight driving signal of the display system in FIG. 1.

FIG. 4 is an illustration of a second correlation of the data clock signal, the vertical synchronization signal, and the backlight driving signal of the display system 100. Similarly, a first square wave DT1 of the data clock signal corresponds to an image frame Fl. A first square wave DT2 of the data clock signal corresponds to an image frame F2. Specifically, no common time interval is between a first time interval corresponding to the first square wave (DT1 or DT2) and a second time interval corresponding to the second square wave VT2 of the vertical synchronization signal. Here, the second square wave VT2 of the vertical synchronization signal is between the first square wave DT1 and the first square wave DT2. In FIG. 4, the backlight driving signal includes a composite wave CW3, which is synthesized by a third square wave BT3 and at least one pulse width modulation signal RP. Comparing each wave in FIG. 4 with FIG. 3, timing of a falling edge of the third square wave BT3 is outside the second time interval corresponding to the second square wave VT2. Timing of a rising edge of the third square wave BT3 substantially matches with a rising edge of the second time interval corresponding to the second square wave VT2. In FIG. 4, since the timing of the falling edge of the third square wave BT3 is outside the second time interval corresponding to the second square wave VT2, a short common time interval is introduced between the third time interval of the composite wave CW3 and the first time interval of the first square wave DT2 of the data clock signal. In other words, disturbance of the pixel polarities of the pixel array 12 corresponding to the first square wave DT1 can be invisible during a human-viewable time interval S1. However, disturbance of the pixel polarities of the pixel array 12 corresponding to the first square wave DT2 may be visible during a human-viewable time interval S1. Fortunately, a region close to an upper side of the screen and a region close to a lower side of the screen are non-hot zone of vision. As previously mentioned, the image driving device 11 can drive the pixel array 12 by using a row-by-row driving mode. Therefore, disturbance of the pixel polarities of the pixel array 12 corresponding to the first square wave DT2 during a human-viewable time interval S1 can be regarded as disturbance of the pixel polarities of the region close to the upper side of the screen. Thus, for the displayed image during the human-viewable time interval S1, image distortion caused by the motion blur effect can also be mitigated. Further, since the composite wave CW3 with a comparatively large power is introduced to the backlight driving signal, equivalently, a driving voltage of the backlight module 14 is boosted during the third time interval. Thus, the average brightness of the backlight module 14 can be increased. Further, a process for reducing the motion blur effect fora human-viewable time interval SO is similar to the human-viewable time interval S1. Thus, illustrations are omitted here. Additionally, timing of a rising edge of the third square wave BT3 can be within the second time interval of the square wave VT2.

Figure 5:
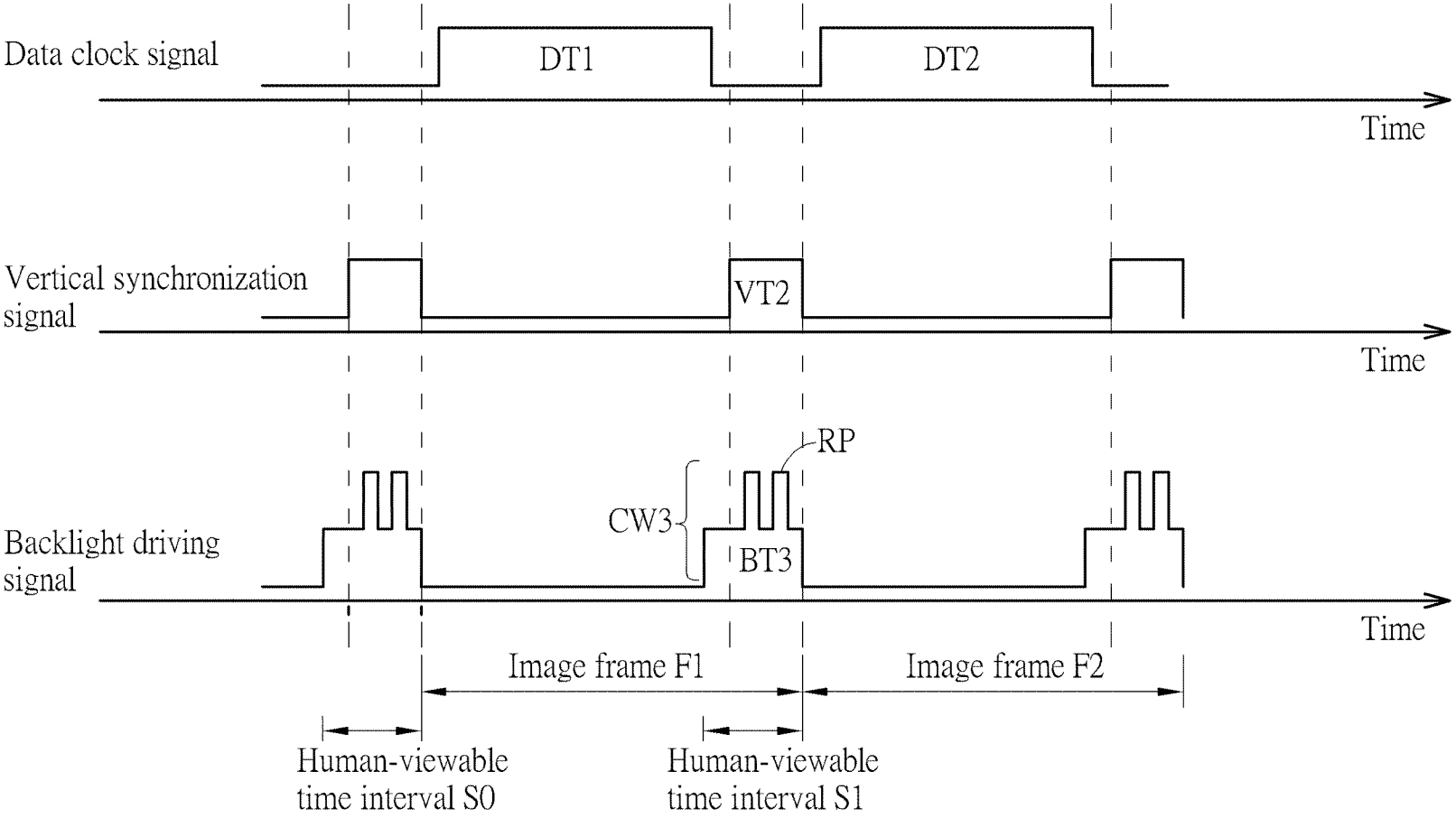
FIG. 5 is an illustration of a third correlation of the data clock signal, the vertical synchronization signal, and the backlight driving signal of the display system in FIG. 1.

FIG. 5 is an illustration of a third correlation of the data clock signal, the vertical synchronization signal, and the backlight driving signal of the display system 100. Similarly, a first square wave DT1 of the data clock signal corresponds to an image frame F1. A first square wave DT2 of the data clock signal corresponds to an image frame F2. Specifically, no common time interval is between a first time interval corresponding to the first square wave (DT1 or DT2) and a second time interval corresponding to the second square wave VT2 of the vertical synchronization signal. Here, the second square wave VT2 of the vertical synchronization signal is between the first square wave DT1 and the first square wave DT2. In FIG. 5, the backlight driving signal includes a composite wave CW3, which is synthesized by a third square wave BT3 and at least one pulse width modulation signal RP. Comparing each wave in FIG. 5 with FIG. 3, timing of a rising edge of the third square wave BT3 is outside the second time interval corresponding to the second square wave VT2. Timing of a falling edge of the third square wave BT3 substantially matches with a falling edge of the second time interval corresponding to the second square wave VT2. In FIG. 5, since the timing of the rising edge of the third square wave BT3 is outside the second time interval corresponding to the second square wave VT2, a short common time interval is introduced between the third time interval of the composite wave CW3 and the first time interval of the first square wave DT1 of the data clock signal. In other words, disturbance of the pixel polarities of the pixel array 12 corresponding to the first square wave DT1 may be visible during a human-viewable time interval S1. Fortunately, a region close to an upper side of the screen and a region close to a lower side of the screen are non-hot zone of vision. As previously mentioned, the image driving device 11 can drive the pixel array 12 by using a row-by-row driving mode. Therefore, the disturbance of the pixel polarities of the pixel array 12 corresponding to the first square wave DT1 during the human-viewable time interval S1 can be regarded as disturbance of the pixel polarities of the region close to the lower side of the screen. Thus, for the displayed image during the human-viewable time interval S1, image distortion caused by the motion blur effect can also be mitigated. Further, since the composite wave CW3 with a comparatively large power is introduced to the backlight driving signal, equivalently, a driving voltage of the backlight module 14 is boosted during the third time interval. Thus, the average brightness of the backlight module 14 can be increased. Further, a process for reducing the motion blur effect for a human-viewable time interval SO is similar to the human-viewable time interval S1. Thus, illustrations are omitted here. Additionally, timing of a falling edge of the third square wave BT3 can be within the second time interval of the square wave VT2.

Figure 6:
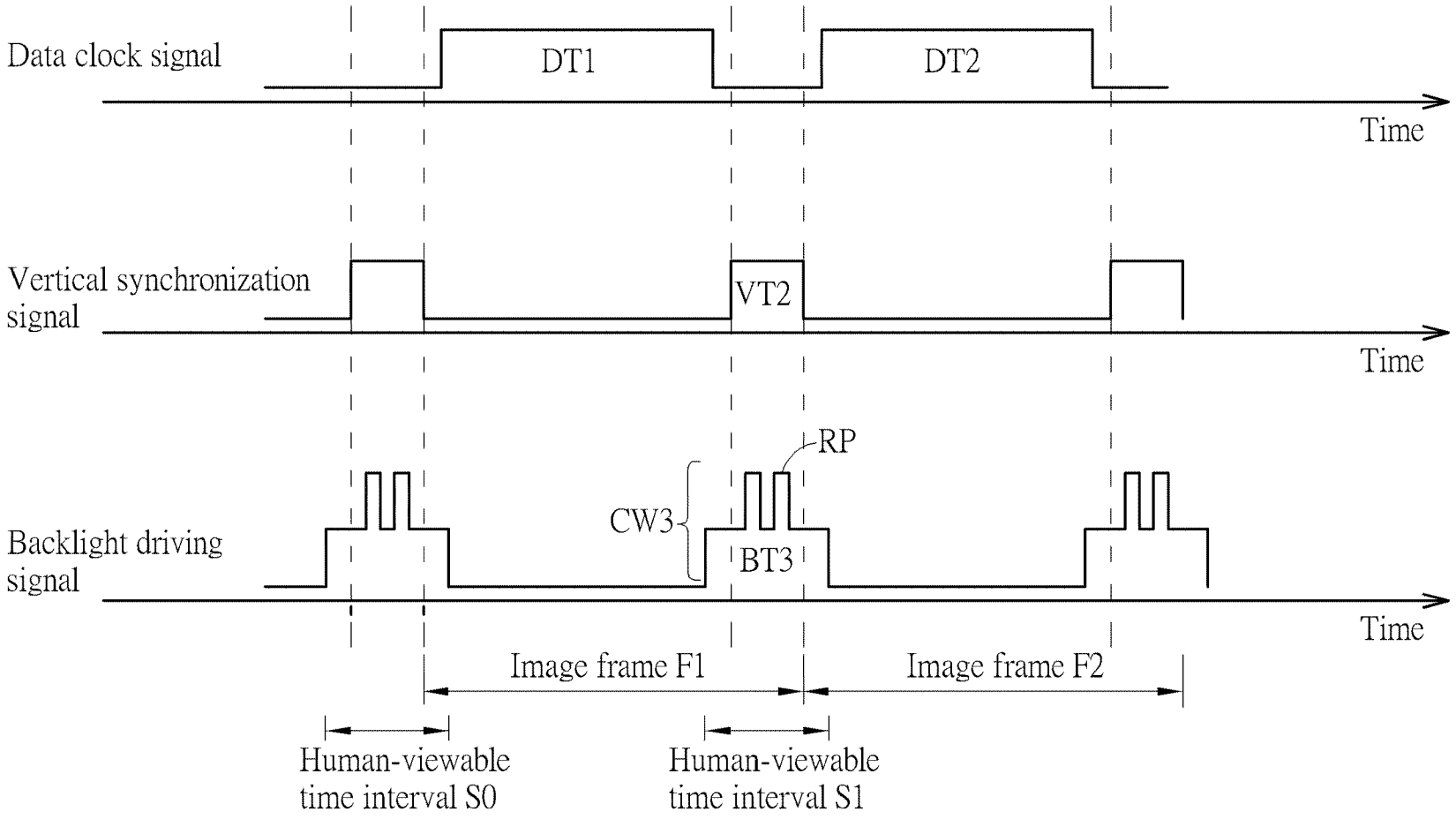
FIG. 6 is an illustration of a fourth correlation of the data clock signal, the vertical synchronization signal, and the backlight driving signal of the display system in FIG. 1.

FIG. 6 is an illustration of a fourth correlation of the data clock signal, the vertical synchronization signal, and the backlight driving signal of the display system 100. Similarly, a first square wave DT1 of the data clock signal corresponds to an image frame F1. A first square wave DT2 of the data clock signal corresponds to an image frame F2. Specifically, no common time interval is between a first time interval corresponding to the first square wave (DT1 or DT2) and a second time interval corresponding to the second square wave VT2 of the vertical synchronization signal. Here, the second square wave VT2 of the vertical synchronization signal is between the first square wave DT1 and the first square wave DT2. In FIG. 6, the backlight driving signal includes a composite wave CW3, which is synthesized by a third square wave BT3 and at least one pulse width modulation signal RP. Comparing each wave in FIG. 6 with FIG. 3, timing of a rising edge of the third square wave BT3 is outside the second time interval corresponding to the second square wave VT2. Timing of a falling edge of the third square wave BT3 is outside the second time interval corresponding to the second square wave VT2. In other words, the second time interval corresponding to the second square wave VT2 is within the third time interval corresponding to the composite wave CW3. As shown in FIG. 6, since the second time interval corresponding to the second square wave VT2 is within the third time interval corresponding to the composite wave CW3, two short common time intervals are introduced between the third time interval of the composite wave CW3 and the first time intervals corresponding to the first square waves DT1 and DT2 of the data clock signal. In other words, disturbance of the pixel polarities of the pixel array 12 corresponding to the first square waves DT1 and DT2 can be visible during a human-viewable time interval S1. Fortunately, a region close to an upper side of the screen and a region close to a lower side of the screen are non-hot zone of vision. As previously mentioned, the image driving device 11 can drive the pixel array 12 by using a row-by-row driving mode. Therefore, the disturbance of the pixel polarities of the pixel array 12 corresponding to the first square waves DT1 and DT2 during a human-viewable time interval S1 can be regarded as disturbance of the pixel polarities of the region close to the lower side of the screen (i.e., disturbance during a common time interval between the first square wave DT1 and the third square wave BT3), and disturbance of the pixel polarities of the region close to the upper side of the screen (i.e., disturbance during a common time interval between the first square wave DT2 and the third square wave BT3). Thus, for the displayed image during the human-viewable time interval S1, image distortion caused by the motion blur effect can also be mitigated. Further, since the composite wave CW3 with a comparatively large power is introduced to the backlight driving signal, equivalently, a driving voltage of the backlight module 14 is boosted during the third time interval. Thus, the average brightness of the backlight module 14 can be increased. Further, a process for reducing the motion blur effect fora human-viewable time interval S0 is similar to the human-viewable time interval S1. Thus, illustrations are omitted here.

Figure 7A:
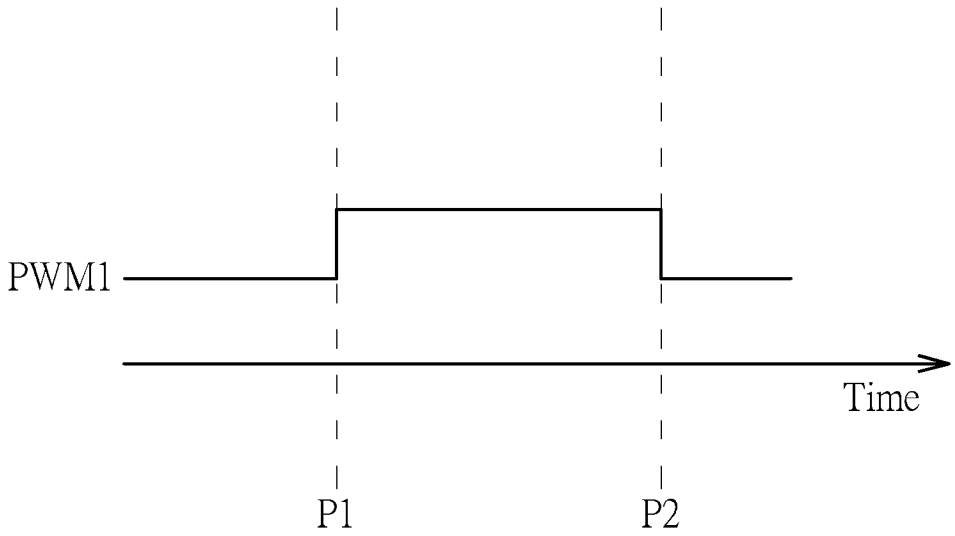
FIG. 7A is an illustration of a first pulse width modulation signal used for synthesizing the backlight driving signal of the display system in FIG. 1.
Figure 7B:
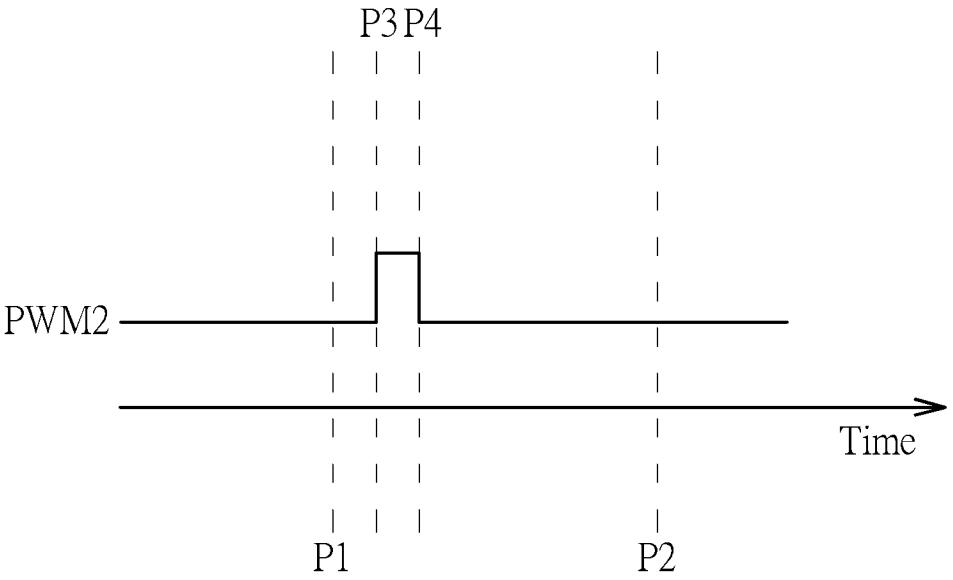
FIG. 7B is an illustration of a second pulse width modulation signal used for synthesizing the backlight driving signal of the display system in FIG. 1.
Figure 7C:
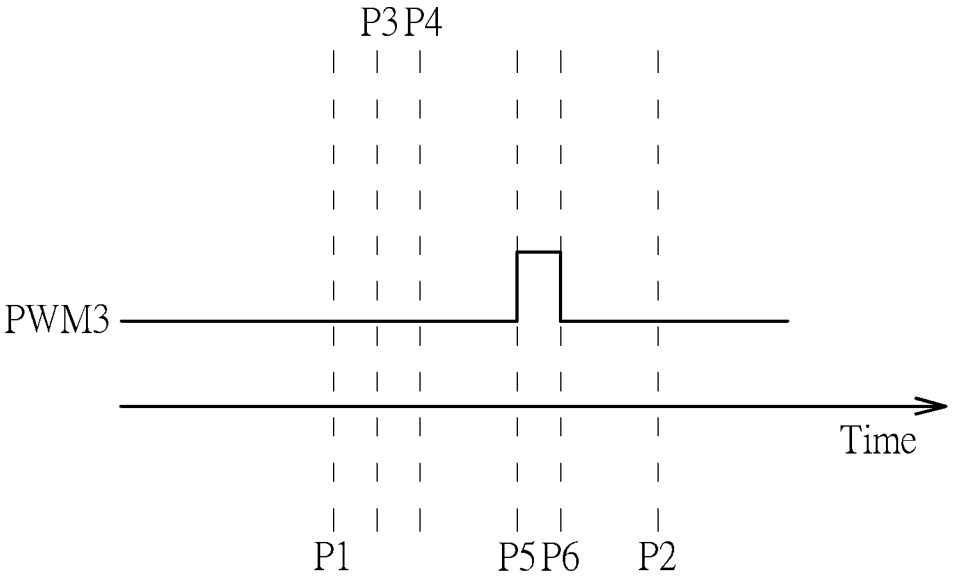
FIG. 7C is an illustration of a third pulse width modulation signal used for synthesizing the backlight driving signal of the display system in FIG. 1.
Figure 7D:
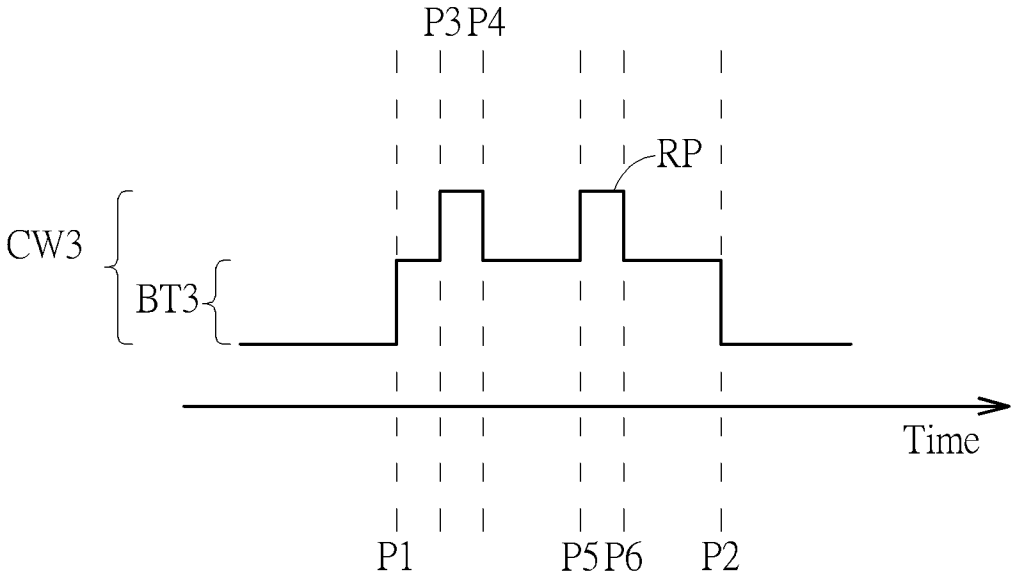
FIG. 7D is an illustration of synthesizing the backlight driving signal by using the backlight driving signals in FIG. 7A to FIG. 7C.

FIG. 7A is an illustration of a first pulse width modulation signal PWM1 used for synthesizing the backlight driving signal of the display system 100. FIG. 7B is an illustration of a second pulse width modulation signal PWM2 used for synthesizing the backlight driving signal of the display system 100. FIG. 7C is an illustration of a third pulse width modulation signal PWM3 used for synthesizing the backlight driving signal of the display system 100. FIG. 7D is an illustration of synthesizing the backlight driving signal by using the backlight driving signals PWM1 to PWM3 shown in FIG. 7A to FIG. 7C. As previously mentioned, in the display system 100, in order to mitigate or eliminate image distortion caused by the motion blur effect, a backlight driving signal with a small duty cycle can be used for avoiding appearance of disturbance of the pixel polarities during the human-viewable time interval. However, using the backlight driving signal with the small duty cycle for driving the backlight module 14 implies using a signal with a small power for driving the backlight module 14. As a result, the backlight module 14 may generate a light signal with insufficient brightness. The displayed image may suffer from insufficient brightness. In order to boost brightness of the displayed image, the composite wave CW3 with a comparatively large power is introduced to the backlight driving signal. Equivalently, a driving voltage of the backlight module 14 is boosted during the third time interval. Thus, average brightness of the backlight module 14 can be increased. A generation method of the composite wave CW3 is illustrated below. As shown in FIG. 7A to FIG. 7D, the composite wave CW3 includes two additional voltage boosting intervals. However, the present invention is not limited to a specific distribution of additional voltage boosting intervals and number of additional voltage boosting intervals of the composite wave CW3. In FIG. 7A, timing of a rising edge of the first pulse width modulation signal PWM1 is denoted as a time point P1. Timing of a falling edge of the first pulse width modulation signal PWM1 is denoted as a time point P2. In FIG. 7B, timing of a rising edge of the second pulse width modulation signal PWM2 is denoted as a time point P3. Timing of a falling edge of the second pulse width modulation signal PWM2 is denoted as a time point P4. In FIG. 7C, timing of a rising edge of the third pulse width modulation signal PWM3 is denoted as a time point P5. Timing of a falling edge of the third pulse width modulation signal PWM3 is denoted as a time point P6. In the display system 100, the composite wave can be synthesized by using linear combinations of a plurality of pulse width modulation signals. Thus, the composite wave CW3 shown in FIG. 7D can be synthesized by using linear combinations of the first pulse width modulation signal PWM1, the second pulse width modulation signal PWM2, and the third pulse width modulation signal PWM3. In FIG. 7D, the composite wave CW3 includes a square wave portion (i.e., the third square wave BT3) and two pulse width modulation signals RP added to the square wave portion. Timing of a rising edge of the third square wave BT3 is denoted as a time point Pl. Timing of a falling edge of the third square wave BT3 is denoted as a time point P2. In FIG. 7D, two time intervals of signal waves RP correspond to time intervals of the second pulse width modulation signal PWM2 and the third pulse width modulation signal PWM3. The time intervals of the signal waves RP are defined during the time points P3 to P4, and the time points P5 to P6. However, any reasonable hardware or technology modification falls into the scope of the present invention. For example, the composite wave CW3 can include more signal waves RP. Equivalently, the composite wave CW3 can be synthesized by more pulse width modulation signals. Further, the display system 100 can be applied to a direct back-lit display system or an edge LED back-lit display system. Further, all light-emitting components (i.e., LEDs D1 to DM) of a light-emitting array of the backlight module 14 during the third time interval corresponding to the composite wave CW3 are enabled simultaneously. All light-emitting components of the light-emitting array of the backlight module 14 are disabled simultaneously after the third time interval elapses. By doing so, an image flickering effect caused by a one-by-one or row-by-row method of enabling the light-emitting components can be removed.

In order to further improve image quality, an overdrive (OD) technology can be introduced to the display system 100. For example, a plurality of driving voltage tables corresponding to a plurality of refresh frequencies can be used in the display system 100. The plurality of driving voltage tables can be a plurality of OD lookup tables (OD-LUTs). For example, an OD-LUT for 240 Hz, an OD-LUT for 180 Hz, an OD-LUT for 144 Hz, and an OD-LUT for 60 Hz can be used in the display system 100. The OD-LUTs include information of boosting gains, such as voltage gain factors. The display system 100 can boost driving voltages of pixels during a first time interval of the data clock signal according to an OD-LUT corresponding to a current refresh frequency. By doing so, since driving voltages of pixels can be boosted, polarities of pixels can be rapidly converged to a steady state. Thus, image distortion caused by the motion blur effect can be further reduced. Further, a boosting gain corresponding to a small refresh frequency is smaller than a boosting gain corresponding to a large refresh frequency. For example, a boosting gain corresponding to a refresh frequency equal to 240 Hz is greater than a boosting gain corresponding to a refresh frequency equal to 180 Hz. A boosting gain corresponding to a refresh frequency equal to 180 Hz is greater than a boosting gain corresponding to a refresh frequency equal to 144 Hz. A boosting gain corresponding to a refresh frequency equal to 144 Hz is greater than a boosting gain corresponding to a refresh frequency equal to 60 Hz.

Figure 8:
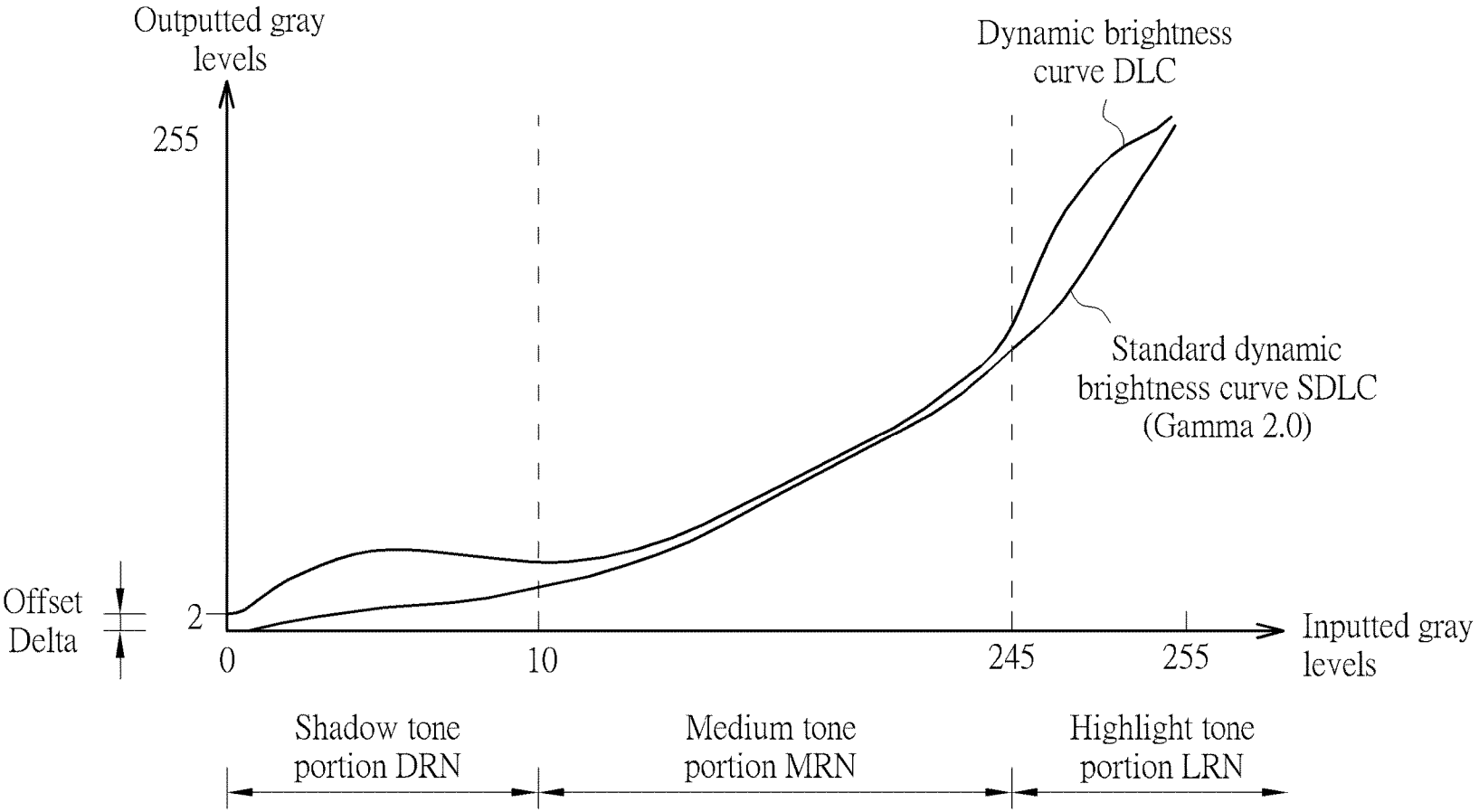
FIG. 8 is an illustration of adjusting a dynamic brightness curve of the display system in FIG. 1.

FIG. 8 is an illustration of adjusting a dynamic brightness curve DLC of the display system 100. In order to further increase image brightness, the display system 100 can adjust the dynamic brightness curve DLO. In FIG. 8, X axis is denoted as an axis of inputted gray levels. Y axis is denoted as an axis of outputted gray levels. A pre-determined dynamic brightness curve of the display system 100 can be a standard dynamic brightness curve SDLC, such as a standard dynamic brightness curve with Gamma 2.0 protocol. A shadow tone portion DRN, a medium tone portion MRN, and a highlight tone portion LRN can be introduced to the X axis for partitioning ranges of the dynamic brightness curve DLO and the standard dynamic brightness curve SDLC. For increasing image brightness, the dynamic brightness curve DLC can be appropriately adjusted. Here, dynamic brightness curve DLC can be adjusted so as to increase at least one portion of the dynamic brightness curve DLO above a standard dynamic brightness curve SDLC. As shown in FIG. 8, the dynamic brightness curve DLC can be adjusted above the standard dynamic brightness curve SDLC within ranges of the shadow tone portion DRN and the highlight tone portion LRN. The dynamic brightness curve DLC is close to the standard dynamic brightness curve SDLC within a range of the medium tone portion MRN. In the embodiment, a gray level G1 corresponding to the shadow tone portion DRN can satisfy $0 \leq G1 < 10$.A gray level G2 corresponding to the medium tone portion MRN can satisfy $10 \leq G2 < 245$. A gray level G3 corresponding to the highlight tone portion LRN can satisfy $245 \leq G3 < 255$. However, ranges of the shadow tone portion DRN, the medium tone portion MRN, and the highlight tone portion LRN are not limited to the embodiment. Further, a small offset between the dynamic brightness curve DLC and the standard dynamic brightness curve SDLC can be introduced at X=0 (i.e., inputted gray level is equal to zero). For example, the small offset Delta equal to two gray levels between the dynamic brightness curve DLC and the standard dynamic brightness curve SDLC can be introduced at X=0. By adjusting the dynamic brightness curve DLC, the display system 100 can display the image with enhanced brightness.

To sum up, the present invention discloses a display system for displaying an image with a high quality by reducing the motion blur effect. Timing of enabling backlight module and timing of processing polarities of pixels under a transient state are interleaved or slightly overlapped. Since the polarities of pixels are converged to a steady state during a human-viewable time interval, the motion blur effect can be minimized during the human-viewable time interval. Further, the display system is capable of performing an overdrive process according to a plurality of driving voltage tables corresponding to a plurality of refresh frequencies. The overdrive process can boost a driving signal of the pixel array so that the polarities of pixels can be rapidly converged to the steady state. Therefore, by using the overdrive process, the motion blur effect can be further reduced. Additionally, in order to further increase image brightness, the display system can adjust a dynamic brightness curve, such as increasing the dynamic brightness curve within ranges of the shadow tone portion and the highlight tone portion. By adjusting the dynamic brightness curve, the image brightness can be further boosted and compensated.

Those skilled in the art will readily observe that numerous modifications and alterations of the device and method may be made while retaining the teachings of the invention.

Accordingly, the above disclosure should be construed as limited only by the metes and bounds of the appended claims.

What is claimed is:

1. A method for displaying an image comprising:
acquiring a data clock signal;
acquiring a vertical synchronization signal;
generating a backlight driving signal according to the vertical synchronization signal; and
displaying the image by using a display system according to the data clock signal, the vertical synchronization signal, and the backlight driving signal;
wherein the data clock signal comprises a first square wave, the vertical synchronization signal comprises a second square wave, and no common time interval is between a first time interval corresponding to the first square wave and a second time interval corresponding to the second square wave; and
wherein the backlight driving signal comprises a composite wave synthesized by a third square wave and at least one pulse width modulation signal.

2. The method of claim 1, wherein a third time interval corresponding to the composite wave is within the second time interval.

3. The method of claim 1, wherein a portion of a third time interval corresponding to the composite wave is outside the second time interval.

4. The method of claim 3, wherein timing of a falling edge of the third square wave is outside the second time interval, and timing of a rising edge of the third square wave substantially matches with a rising edge of the second time interval.

5. The method of claim 3, wherein timing of a rising edge of the third square wave is outside the second time interval, and timing of a falling edge of the third square wave substantially matches with a falling edge of the second time interval.

6. The method of claim 1, wherein the second time interval is within a third time interval corresponding to the composite wave.

7. The method of claim 1, further comprising:
enabling all light-emitting components of a light-emitting array of a backlight module during a third time interval corresponding to the composite wave; and
disabling all light-emitting components of the light-emitting array of the backlight module after the third time interval elapses.

8. The method of claim 1, wherein the display system is a direct back-lit display system or an edge light-emitting diode (LED) back-lit display system.

9. The method of claim 1, wherein the third square wave is a pulse width modulation signal, and a peak duty cycle of the pulse width modulation signal is substantially equal to 1/20.

10. The method of claim 1, wherein the backlight driving signal is generated by a backlight driving control device, and the backlight driving control device generates the backlight driving signal according to at least one pulse width modulation signal.

11. The method of claim 1, further comprising:
boosting a driving voltage corresponding to the data clock signal according to a driving voltage table of a plurality of driving voltage tables;
wherein the plurality of driving voltage tables correspond to a plurality of refresh frequencies.

12. The method of claim 11, wherein the plurality of refresh frequencies comprises a plurality of different refresh frequencies predetermined in an ascending order, each driving voltage table of the plurality of driving voltage tables comprises a boosting gain, and a boosting gain corresponding to a small refresh frequency is smaller than a boosting gain corresponding to a large refresh frequency.

13. The method of claim 1, further comprising:
adjusting a dynamic brightness curve of the display system so as to increase at least one portion of the dynamic brightness curve above a standard dynamic brightness curve.

14. The method of claim 13, wherein the dynamic brightness curve comprises a shadow tone portion, a medium tone portion, and a highlight tone portion, a shadow tone portion and a highlight tone portion of the adjusted dynamic brightness curve are above the standard dynamic brightness curve, and a medium tone portion is close to the standard dynamic brightness curve.

15. A display system comprising:
a backlight driving device configured to generate a switch control signal and a current control signal according to a current dividing signal, a backlight driving signal, and a maximum current setting signal; and
a backlight module coupled to the backlight driving device and configured to drive at least one light-emitting diode string according to the switch control signal and the current control signal;
wherein the backlight driving device comprises a driving circuit configured to receive the current dividing signal through a voltage divider formed by a plurality of resistors, the backlight driving signal through a resistor-capacitor (RC) circuit, and the maximum current setting signal through a resistor; and
wherein the backlight driving signal comprises a composite wave synthesized by a third square wave and at least one pulse width modulation signal.

16. The display system of claim 15, further comprising:
a processor device coupled to the backlight driving device and configured to generate a data clock signal and a vertical synchronization signal;
wherein the backlight driving signal is generated according to the vertical synchronization signal, the data clock signal comprises a first square wave, the vertical synchronization signal comprises a second square wave, and no common time interval is between a first time interval corresponding to the first square wave and a second time interval corresponding to the second square wave.

17. The display system of claim 16, wherein a third time interval corresponding to the composite wave is within the second time interval.

18. The display system of claim 16, wherein a portion of a third time interval corresponding to the composite wave is outside the second time interval.

19. The display system of claim 18, wherein timing of a falling edge of the third square wave is outside the second time interval, and timing of a rising edge of the third square wave substantially matches with a rising edge of the second time interval.

20. The display system of claim 18, wherein timing of a rising edge of the third square wave is outside the second time interval, and timing of a falling edge of the third square wave substantially matches with a falling edge of the second time interval.

21. The display system of claim 16, wherein the second time interval is within a third time interval corresponding to the composite wave.

* * * * *